US008579407B2

(12) United States Patent
Yabe

(10) Patent No.: US 8,579,407 B2
(45) Date of Patent: Nov. 12, 2013

(54) INKJET RECORDING APPARATUS AND ABNORMALITY DETECTION METHOD FOR LIQUID DISCHARGE HEAD

(75) Inventor: Kenji Yabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 358 days.

(21) Appl. No.: 13/007,428

(22) Filed: Jan. 14, 2011

(65) Prior Publication Data

US 2011/0175963 A1 Jul. 21, 2011

(30) Foreign Application Priority Data

Jan. 21, 2010 (JP) ..... 2010-010939

(51) Int. Cl.
*B41J 29/393* (2006.01)

(52) U.S. Cl.
USPC ..... 347/19

(58) Field of Classification Search
USPC ..... 347/14, 19
See application file for complete search history.

(56) References Cited

U.S. PATENT DOCUMENTS 5,530,462 A * 6/1996 Takahashi et al. ..... 347/23
2011/0175963 A1* 7/2011 Yabe ..... 347/19

FOREIGN PATENT DOCUMENTS

CN 101372168 A 2/2009
JP 9-057973 A 3/1997

* cited by examiner

*Primary Examiner* — Uyen Chau N Le
*Assistant Examiner* — Kajli Prince
(74) *Attorney, Agent, or Firm* — Canon USA, Inc., IP Division

(57) ABSTRACT

An inkjet recording apparatus may include a liquid discharge head and a control unit. The liquid discharge head includes a heat generation resistor to generate thermal energy used for discharging liquid and a protection film disposed in at least one of an upper portion and a lower portion of the heat generation resistor. The control unit measures a minimum energy value required by the heat generation resistor to discharge liquid. In addition, the control unit stops discharge operation of the liquid discharge head when at least one of the energy value and a statistical value of the energy value is less than a threshold.

14 Claims, 10 Drawing Sheets

INKJET RECORDING APPARATUS AND ABNORMALITY DETECTION METHOD FOR LIQUID DISCHARGE HEAD

BACKGROUND OF THE INVENTION

1. Field of the Invention

The present invention relates to a thermal-type inkjet recording apparatus and an abnormality detection method of a liquid discharge head.

2. Description of the Related Art

An inkjet recording apparatus includes a thermal-type inkjet recording apparatus in which an inkjet recording head manufactured with a technology such as a chemical vapor deposition (CVD) method heats ink and discharges the ink (discussed in Japanese Patent Application Laid-Open No. 9-57973).

FIG. 11 illustrates a cross-sectional view of a configuration of an inkjet recording head used for a conventional thermal-type inkjet recording apparatus.

In an inkjet recording head 500 illustrated in FIG. 11, a thermal accumulation layer 502, a lower protection film 503, a heat generation resistor 504, a wiring 505, an upper protection film 506, and a nozzle member 507 are laminated on a substrate 501. A supply port 508 to which ink flows is formed in the inkjet recording head 500. The lower protection film 503 and the upper protection film 506 come into contact with the supply port 508.

In the inkjet recording head 500, a voltage is applied to the heat generation resistor 504 via the wiring 505. Then, the heat generation resistor 504 is heated, and the ink flowing from the supply port 508 is also heated. The ink is discharged from a discharge port 509 formed in the nozzle member 507 in air bubbles generated by the heating. In the inkjet recording head 500, the upper protection film 506 and the lower protection film 503 are formed, thereby protecting the heat generation resistor 504 and the wiring 505 from the ink.

In the inkjet recording head 500, the upper protection film 506 and the lower protection film 503 generally contain a silicon compound. Therefore, depending on the kind of ink, the upper protection film 506 and the lower protection film 503 can be temporally corroded from a contact portion with the supply port 508.

FIG. 12 illustrates a cross-sectional view of a status in which the inkjet recording head 500 in FIG. 11 is corroded by ink. Referring to FIG. 12, the corrosion with the ink enhances a dissolution region (refer to a region C) of the upper protection film 506 and the lower protection film 503. Then, the ink enters the wiring 505. Then, there is a danger that the inkjet recording head 500 is not normally operated.

SUMMARY OF THE INVENTION

According to an aspect of the embodiments, an inkjet recording apparatus may include a liquid discharge head and a control unit. The liquid discharge head includes a heat generation resistor to generate thermal energy used for discharging liquid and a protection film disposed in at least one of an upper portion and a lower portion of the heat generation resistor. The control unit measures a minimum energy value required by the heat generation resistor to discharge liquid. In addition, the control unit stops discharge operation of the liquid discharge head when at least one of the energy value and a statistical value of the energy value is less than a threshold.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the embodiments and, together with the description, serve to explain the principles of the embodiments.

DESCRIPTION OF THE EMBODIMENTS

Various exemplary embodiments, features, and aspects of the invention will be described in detail below with reference to the drawings.

With an embodiment configuration, even if the protection film is dissolved by the ink flowing from the supply port, the change in energy value is detected at the time, so that the recording operation of the inkjet recording head can be immediately stopped. Thus, the damage of the inkjet recording head can be suppressed to the minimum level.

Figure 1:
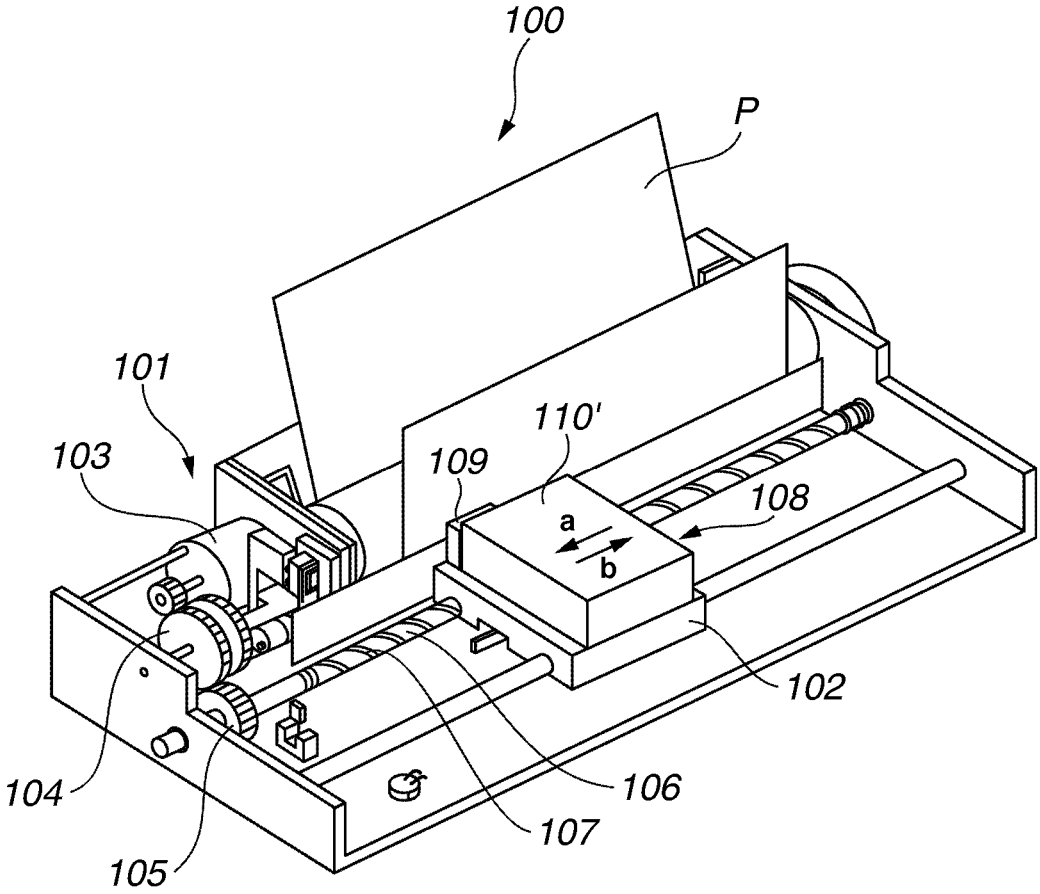
FIG. 1 is a perspective view of an inkjet recording apparatus according to a first exemplary embodiment.

FIG. 1 is a perspective view of an inkjet recording apparatus according to a first exemplary embodiment.

An inkjet recording apparatus 100 in FIG. 1 includes a main body 101, and a carriage 102 placed on the main body 101. In the main body 101, a leadscrew 106 is rotated by rotation force from gears 104 and 105 interlocked to rotation of a motor 103. A spiral groove 107 is provided in the leadscrew 106, and a carriage 102 is reciprocated and moved in a width direction (refer to arrows a and b) of recording paper P, to be engaged with the spiral groove 107. A cartridge 108 is detachable to the carriage 102.

Figure 2:
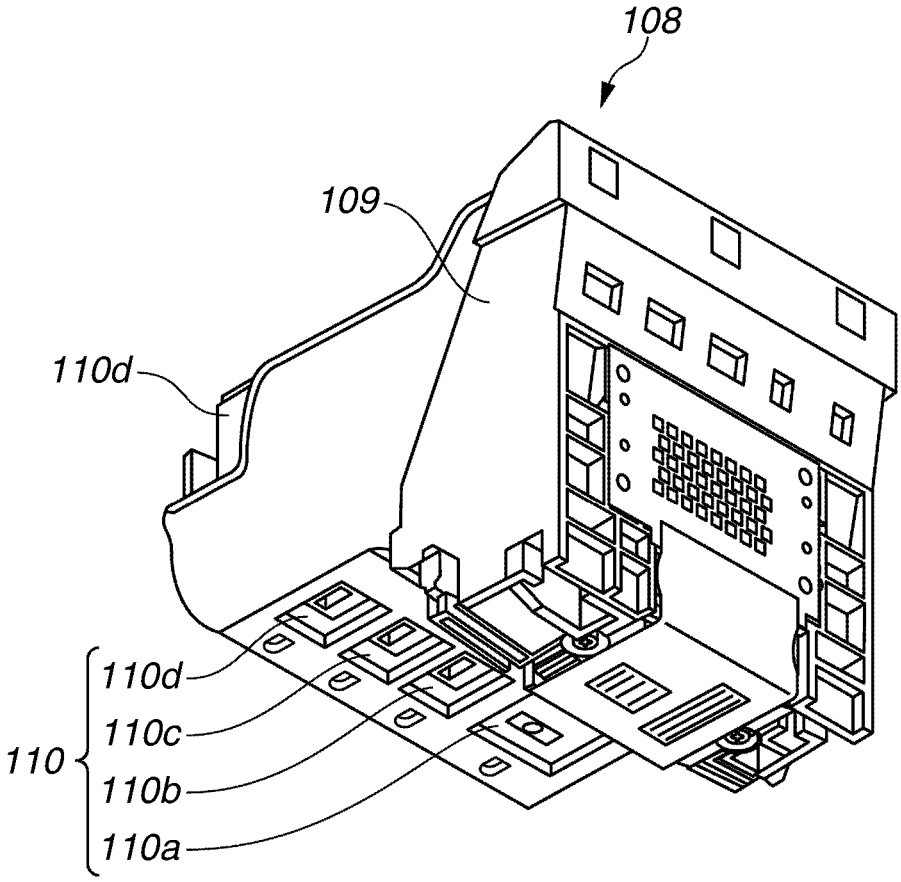
FIG. 2 illustrates a perspective view of a configuration of a cartridge in an inkjet recording apparatus in FIG. 1.

FIG. 2 illustrates a perspective view of a configuration of the cartridge 108 in the inkjet recording apparatus 100 in FIG. 1.

The cartridge 108 in FIG. 2 includes an inkjet recording head 109 and an ink tank 110 detachable to the inkjet recording head 109. The inkjet recording head 109 discharges ink (or reaction liquid) supplied from the ink tank 110 according to recording information. Referring to FIG. 2, the ink tank 110 includes ink tanks 110*a* to 110*d*. Black ink is contained in the ink tank 110*a*, and cyan ink is contained in the ink tank 110*b*. Magenta ink is contained in the ink tank 110*c*, and yellow ink is contained in the ink tank 110*d*. The ink tanks 110*a* to 110*d* are detachable to the inkjet recording head 109, and the ink tanks can be thus exchanged. Therefore, running costs of printing are reduced in the inkjet recording apparatus 100.

A form of the ink supply is not limited to a form in which the ink tank 110 is detachable to the inkjet recording head 109. For example, the ink tank 110 may be attached to the main body 101, and the ink may be supplied to the inkjet recording head 109 via a tube.

Next, a specific description is given of the configuration of the inkjet recording head 109.

Figure 3:
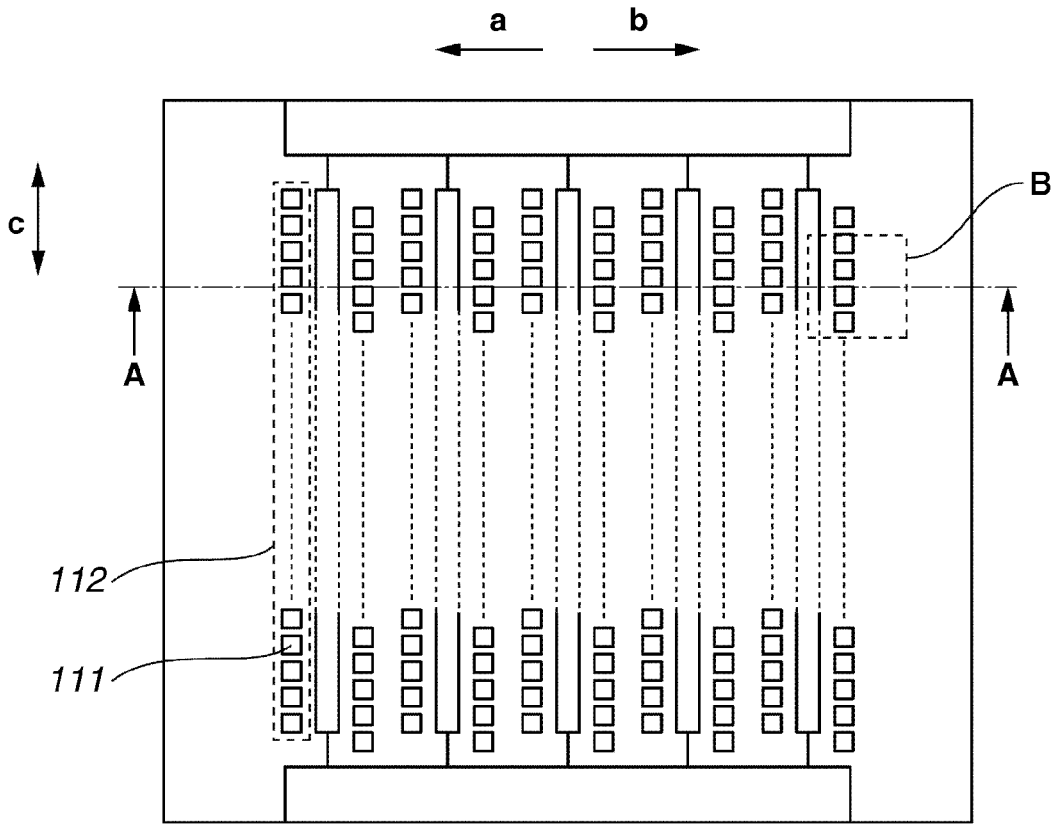
FIG. 3 illustrates a plan view of an inkjet recording head in FIG. 2 in an ink discharge direction.

FIG. 3 illustrates a plan view of the inkjet recording head 109 in FIG. 2 in the ink discharge direction. Referring to FIG. 3, a plurality of discharge ports 111 are aligned in the inkjet recording head 109. According to the present exemplary embodiment, the discharge ports 111 are aligned in the sub-scanning direction (refer to an arrow c) of the inkjet recording head 109 with a pitch of 600 dpi (dots per inch) per line (approximately 42 μm) to form a discharge port line 112. The two discharge port lines 112 per supply port line are arranged apart in the main scanning direction (refer to arrows a and b) of the inkjet recording head 109 in the displaced status approximately 21 μm in the sub-scanning direction. Thus, the inkjet recording head 109 realizes resolution of 1200 dpi. According to the present exemplary embodiment, the discharge port line 112 is arranged so that the color order of three colors (yellow, magenta, and cyan) is the same both in the forward direction (refer to the arrow a) or in the backward direction (refer to the arrow b) of the main scanning direction of the inkjet recording head 109.

Figure 4:
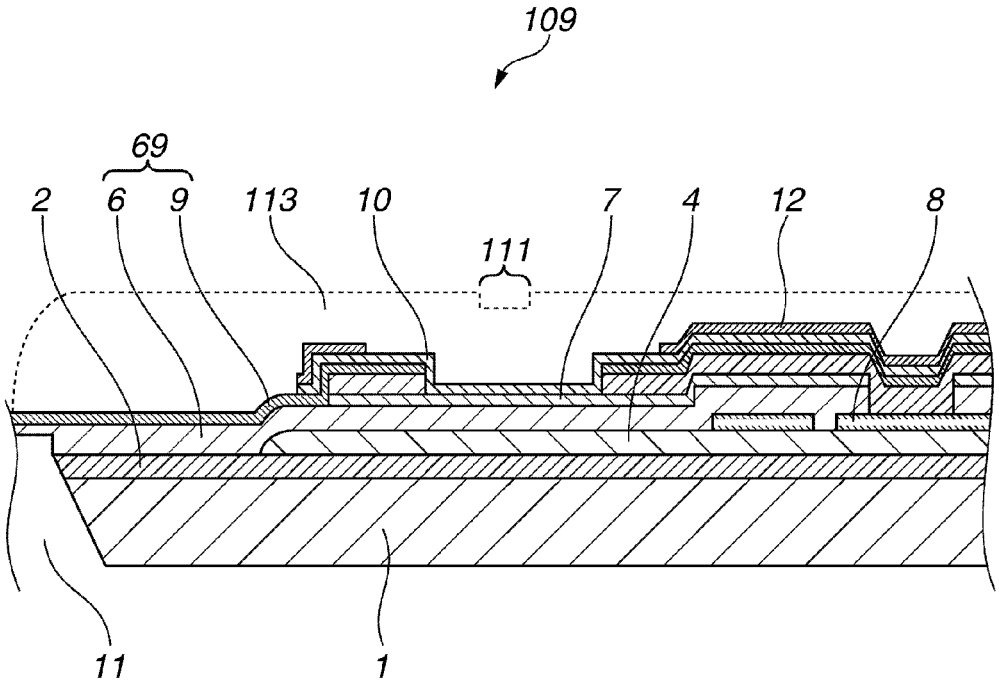
FIG. 4 illustrates a cross-sectional view of enlargement of a region B from a cross section along a section line A to A in FIG. 3.

FIG. 4 illustrates a cross-sectional view of an enlarged region B in the cross section along a section line AA in FIG. 3.

In the inkjet recording head 109, on a substrate 1 containing silicon having the thickness of 625 μm, a thermal accumulation layer 2 containing a thermal oxide film having the thickness of $6500\times10^{-10}$ m is formed. On the thermal accumulation layer 2, an interlayer insulation film 4 containing oxide silicon ($SiO_2$) having the thickness of $5000\times10^{-10}$ m is formed with a CVD method.

The lower protection film 6 containing oxide silicon ($SiO_2$) having the thickness of $15000\times10^{-10}$ m is formed on the interlayer insulation film 4 with a plasma CVD method. Subsequently, a pattern for through-hole is formed in the lower protection film 6 with photolithography, and a through-hole portion (not illustrated) and a pad hole portion (not illustrated) for wire binding are formed with dry etching. Next, a plurality of heat generation resistors 7 containing TaSiN and a wiring 8 containing Al having the thickness of $500\times10^{-10}$ m, connected to the heat generation resistors 7, are formed with reactive sputtering. A wiring pattern is formed with photolithography, and Al and TaN are sequentially etched with reactive ion etching. In order to expose a heat generation portion with the photolithography again, Al is removed with wet etching. The portion corresponds to the heat generation resistors 7. The heat generation resistors 7 are heated by applying a voltage via the wiring 8.

After forming the heat generation resistors 7, the upper protection film 9 containing silicon nitride (SiN) having the thickness of $3000\times10^{-10}$ m is formed with a plasma CVD method. Subsequently, a cavitation-resistant film 10 containing a Ta film having the thickness of $2300\times10^{-10}$ m is formed with a sputtering method.

Referring to FIG. 4, a protection film 69 includes a protection film combining the upper protection film 9 and the lower protection film 6, and covers the wiring 8. The upper protection film 9 contains a silicon (Si) compound such as silicon nitride (SiN), and the lower protection film 6 contains a silicon compound such as oxide silicon (SiO). The upper protection film 9 mainly functions as an interlayer insulation film, and the lower protection film 6 mainly functions as a thermal accumulation layer. The film thickness of the upper protection film 9 ranges from 0.2 to 0.8 μm, and the film thickness of the lower protection film 6 ranges from 0.6 to 2 μm. The upper protection film 9 and the lower protection film 6 come into contact with the supply port 11 to which the ink flows, as illustrated in FIG. 4.

The inkjet recording head 109 includes a plurality of the discharge ports 111 formed facing the heat generation resistors 7, and a resin nozzle member 113 for guiding the ink flowing to the supply port 11 to the discharge ports 111 is formed thereto. According to the present exemplary embodiment, a contact improvement layer 12 is disposed to increase the contact property between the cavitation-resistant film 10 and the nozzle member 113. The contact improvement layer 12 can use a material with low dissolving property for the ink to ensure the contact property between the cavitation-resistant film 10 and the nozzle member 113.

In the inkjet recording head 109, recording operation is performed to heat the ink flowing from the supply port 11 with the heat generation resistors 7 and discharge the ink from the discharge ports 111. A control configuration of the recording operation is described below.

Figure 5:
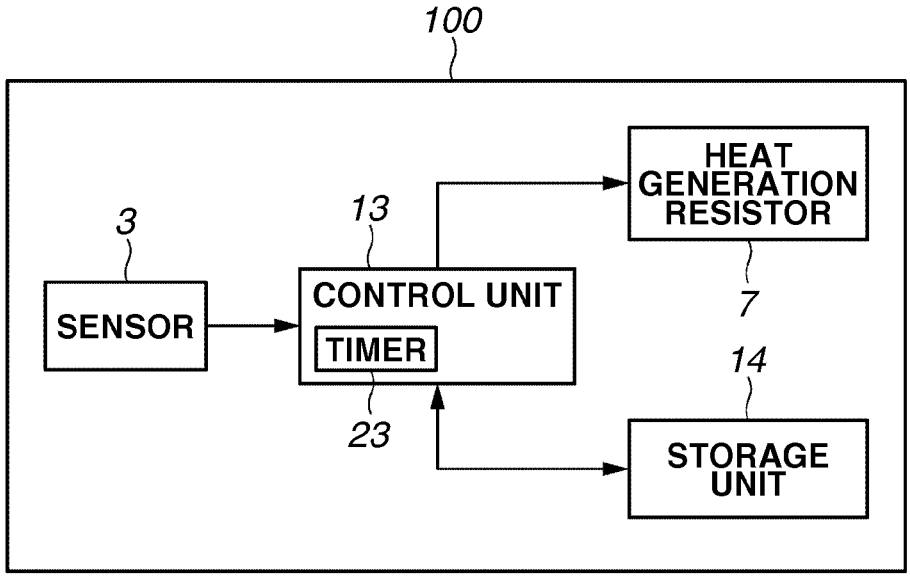
FIG. 5 illustrates a block diagram of a control configuration of recording operation of the inkjet recording apparatus.

FIG. 5 illustrates a block diagram of the control configuration of the recording operation of the inkjet recording apparatus 100.

Figure 6:
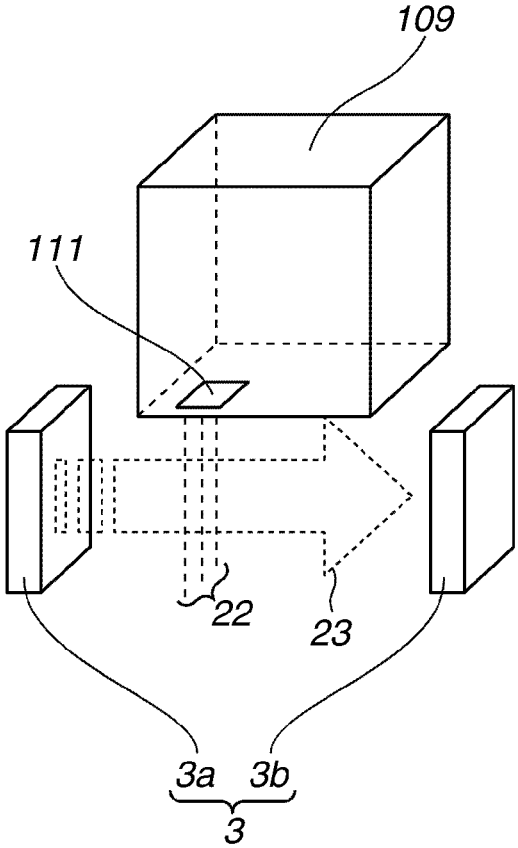
FIG. 6 illustrates a perspective view of a configuration of a sensor disposed in the inkjet recording head.

Referring to FIG. 5, the inkjet recording apparatus 100 includes a sensor 3, a control unit 13, and a storage unit 14. FIG. 6 illustrates a perspective view of the configuration of the sensor 3. Referring to FIG. 6, the sensor 3 includes a light emission portion 3*a* positioned adjacent to a discharge path 22, as a flying path of the ink discharged from the discharge ports 111 and a light reception portion 3*b* facing the light emission portion 3*a* across the discharge path 22, to detect the presence or absence of the ink from the discharge ports 111. In the sensor 3, light 23 is emitted from the light emission portion 3*a* to the light reception portion 3*b*. The light reception portion 3*b* outputs a light reception status of the light 23 output from the light emission portion 3*a* to the control unit 13. When the ink passes through the discharge path 22, the ink shields the light 23, thereby changing the light reception status of the light reception portion 3*b*. The light reception status is indicated by the intensity of the light 23 detected by the light reception portion 3*b*, and the light reception portion 3*b* converts the intensity of the detected light 23 into an electrical signal and outputs the electrical signal to the control unit 13.

The control unit 13 measures an energy value Pth minimum required to discharge the ink from the discharge ports 111 by the heat generation resistor 7 based on the light reception status of the light reception portion 3*b* when stepwise changing at least one of values of voltages applied to the heat generation resistors 7 and voltage application time. According to the present exemplary embodiment, the control unit 13 stepwise changes the application time (pulse width) while fixing the voltage value, and sets the application time minimum required to discharge the ink by the heat generation resistors 7 as the energy value Pth. According to the present exemplary embodiment, the control unit 13 includes a timer 23 to periodically measure the energy value Pth. The control unit 13 measures the energy value Pth, and controls the recording operation of the inkjet recording head 109 based on a result of comparing the energy value Pth with data stored in the storage unit 14.

The storage unit 14 is an electrically erasable and programmable read only memory (EEPROM), and stores various data for the control of the control unit 13. The data includes initial value data indicating the initial value as the first energy value Pth of a plurality of the heat generation resistors 7.

According to the present exemplary embodiment, the control unit 13 is a component in the main body 101, and the storage unit 14 is a component in the inkjet recording head 109. However, the embodiments are not limited to this, and the control unit 13 and the storage unit 14 may be provided in at least one of the main body 101 and the inkjet recording head 109.

Next, a description is given of a series of operation for detecting the abnormality in which the protection film 69 of the inkjet recording head 109 is dissolved by the ink.

Figure 7:
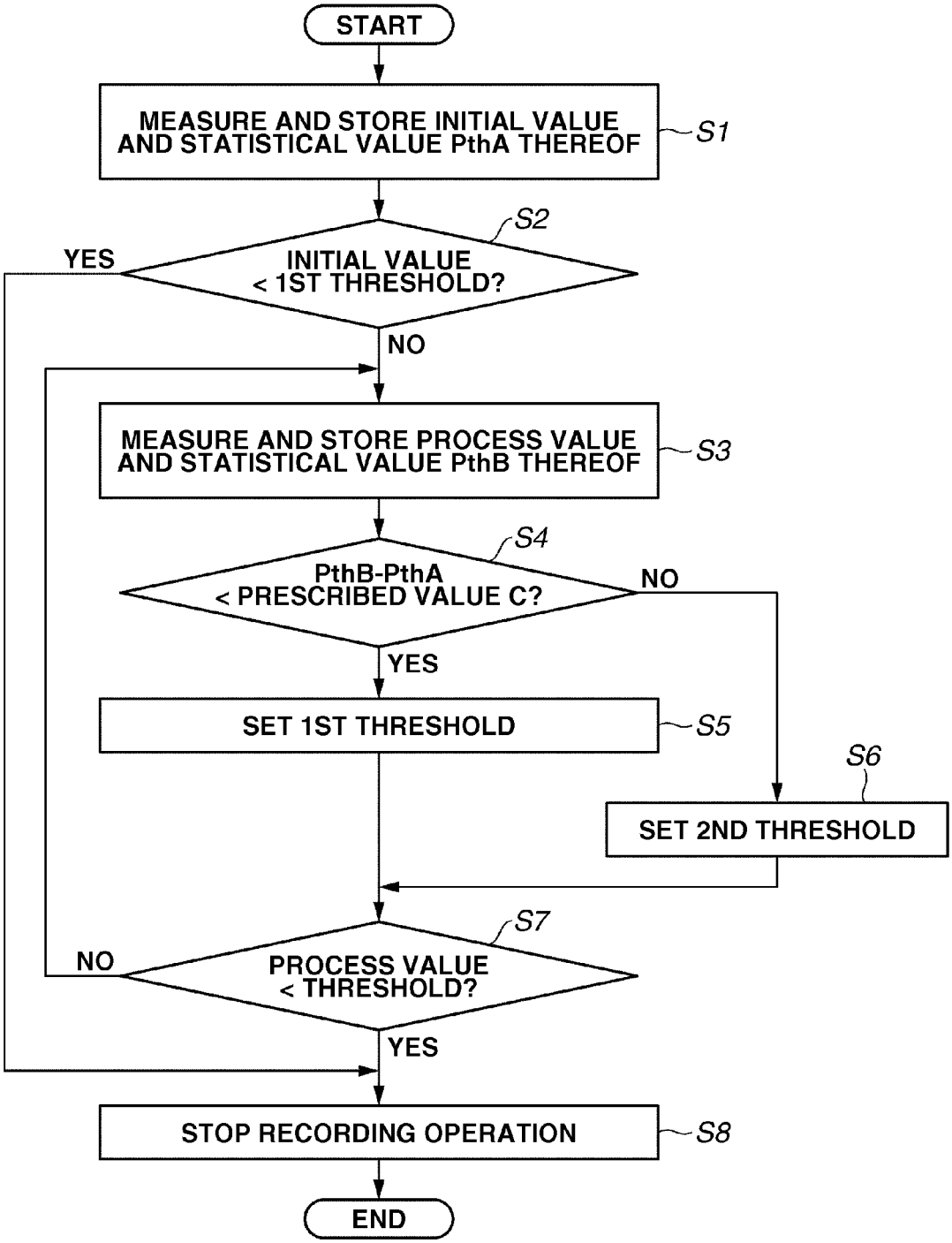
FIG. 7 illustrates a flowchart of a procedure for abnormality detection operation of an inkjet recording head executed by the inkjet recording apparatus according to the first exemplary embodiment.

FIG. 7 illustrates a flowchart of a procedure of the abnormality detection operation of the inkjet recording head 109 executed by the inkjet recording apparatus according to the present exemplary embodiment.

When attaching the inkjet recording head 109, the control unit 13 measures the energy values Pth of all the heat generation resistors 7, i.e., the initial values corresponding to colors, and statistical values PthA (e.g., average values, standard deviation, or movement average) of the initial values. In step S1, the control unit 13 stores the initial value as the initial value data in the storage unit 14, and also stores the statistical value PthA in the storage unit 14.

Figure 12:
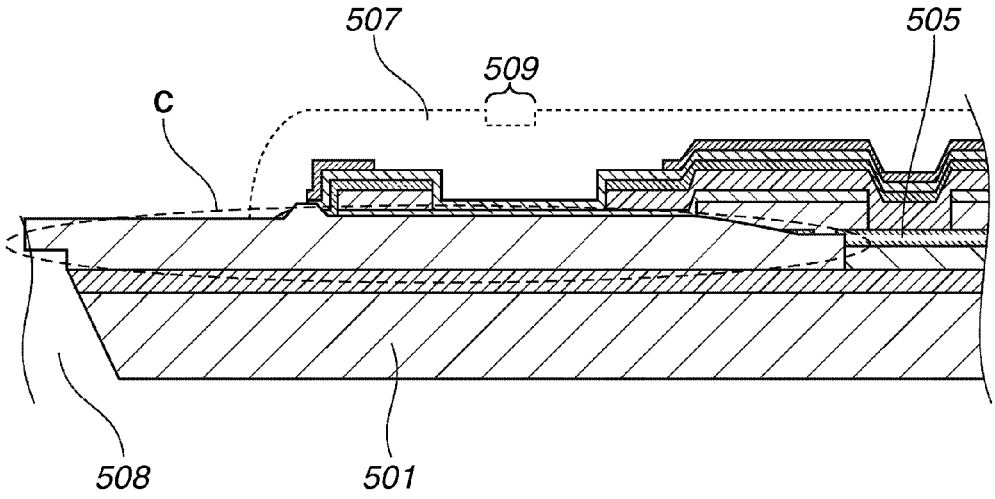
FIG. 12 illustrates a cross-sectional view of a status in which the inkjet recording head in FIG. 11 is corroded by ink.

In step S2, the control unit 13 determines whether any of the initial values is less than the first threshold. When any of the initial values is less than the first threshold (YES in step S2), the control unit 13 determines that the protection film 69 is damaged by a manufacturing default. In step S8, the control unit 13 stops the recording operation of the inkjet recording head 109. When the protection film 69 is damaged at a time of manufacturing or is dissolved by the corrosion of the ink, the ink flows into the supply port 11 and the ink then enters the protection film 69 (refer to FIG. 12). Thus, the heat capacity at the lower portion of the heat generation resistor 7 is sharply reduced, and the ink is therefore easily discharged with energy smaller than that at the normal time. More specifically, the energy value Pth of the heat generation resistor 7 in which the protection film 69 is damaged or dissolved is smaller than the energy value Pth when the protection film 69 is in the normal status. The first threshold is set in advance at the time of measuring the initial value based on an allowance value that can determine that the protection film 69 is not damaged or is not dissolved.

After the control unit 13 confirms that all the initial values are more than the first threshold (NO in step S2), the timer 23 starts to count up the time. After the elapse of predetermined time, in step S3, the control unit 13 measures again all the energy values Pth of the heat generation resistors 7 and the statistical values PthB of the energy values Pth. At this time, the measured energy value Pth is referred to as a process value. The process value and the statistical value PthB are stored in the storage unit 14.

In step S4, the control unit 13 calculates the difference between the statistical value PthB and the statistical value PthA, and determines whether or not the difference is smaller than a predetermined prescribed value C. The prescribed value C is a value for determining whether or not the change in process value is caused by another factor of the dissolution of the protection film 69. When the difference between the statistical values PthB and PthA is smaller than the prescribed value C (YES in step S4), in step S5, the control unit 13 sets a first threshold as a threshold of a comparison target stored in the storage unit 14 of the process value. On the other hand, when the difference between the statistical value PthB and the statistical value PthA is larger than the prescribed value C (NO in step S4), in step S6, the control unit 13 sets a second threshold. The second threshold is obtained by adding the difference between the statistical values PthB and PthA to the first threshold. When the difference between the statistical values PthB and PthA is more than the prescribed value C, the control unit 13 sets the second threshold. As a consequence, when the process value is changed by a factor other than the dissolution of the protection film 69, the influence of the change in process value due to the factor, on the determination as to the dissolution of the protection film 69, becomes smaller. Therefore, the dissolution of the protection film 69 can be precisely detected. A factor other than the dissolution is that a burnt deposit adheres to the surface of the cavitation-resistant film 10, or the film thickness of the cavitation-resistant film 10 becomes thin.

Figure 8:
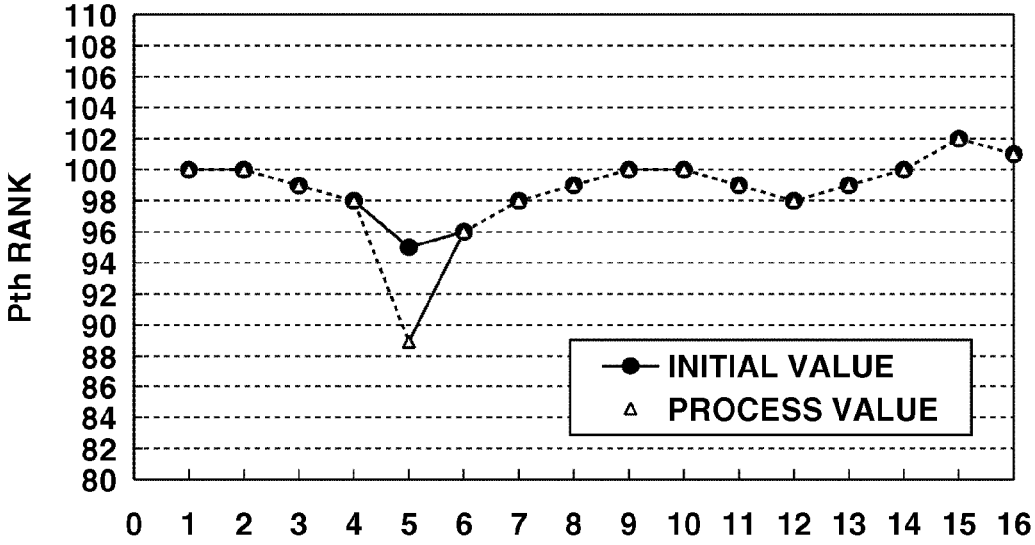
FIG. 8 illustrates a graph of a comparison result between initial values and process values of a plurality of heat generation resistors.

When the thresholds are set, in step S7, the control unit 13 determines whether or not any of the process values is less than the threshold. When any of the process values is less than the threshold (YES in step S7), in step S8, the control unit 13 determines that the protection film 69 is dissolved by the ink, and stops the recording operation of the inkjet recording head 109. FIG. 8 illustrates a graph of a comparison result between the initial values and the process values of a plurality of the heat generation resistors 7. Referring to FIG. 8, the abscissa denotes an identification number of the heat generation resistor 7, and the ordinate denotes a Pth rank indicating the level of the energy value Pth of the heat generation resistor 7. In FIG. 8, in the heat generation resistor 7 with an identification number 5, the process value is greatly reduced, as compared with the initial value. When the process value is less than the set threshold, the control unit 13 determines that the protection film 69 is dissolved by the ink. When all the process values are more than the threshold, the control unit 13 determines that the protection film 69 is not dissolved, resets the timer 23, and returns to the operation in the operation in step S3. The operation in steps S3 to S7 is periodically executed.

When using the operation procedure, a trial term corresponds to ten years, and the dissolution of the protection film 69 is detected before increase of the damage of the inkjet recording head 109 in the inkjet recording apparatus 100 that enters an advancing state of the dissolution of the protection film 69.

According to the present exemplary embodiment, the energy value Pth minimum required to discharge the ink from the discharge port 111 by the heat generation resistor 7 is measured. When the energy value Pth is less than the threshold, the recording operation of the inkjet recording head 109 stops. Therefore, when the protection film 69 dissolves due to the ink flowing from the supply port 11, the change (reduction) in energy value is detected at the time. Therefore, the recording operation of the inkjet recording head 109 immediately stops. Thus, the influence on the main body 101 from the dissolution of the protection film 69 is prevented, thereby suppressing the damage of the inkjet recording head 109 at the minimum level and improving the reliability of a product.

According to the present exemplary embodiment, after step S8 (after the control unit 13 stops the recording operation), information indicating the detection of the abnormality of the inkjet recording head 109 may be output to a computer connected to the inkjet recording apparatus 100. In this case, the computer displays the information, thereby prompting a user to exchange the inkjet recording head 109.

The inkjet recording apparatus according to a second exemplary embodiment is described below. The inkjet recording apparatus according to the present exemplary embodiment is similar to the inkjet recording apparatus 100, except for different contents of the abnormality detection operation of the inkjet recording head. Therefore, a specific description is omitted about the contents similar to the first exemplary embodiment.

Figure 9:
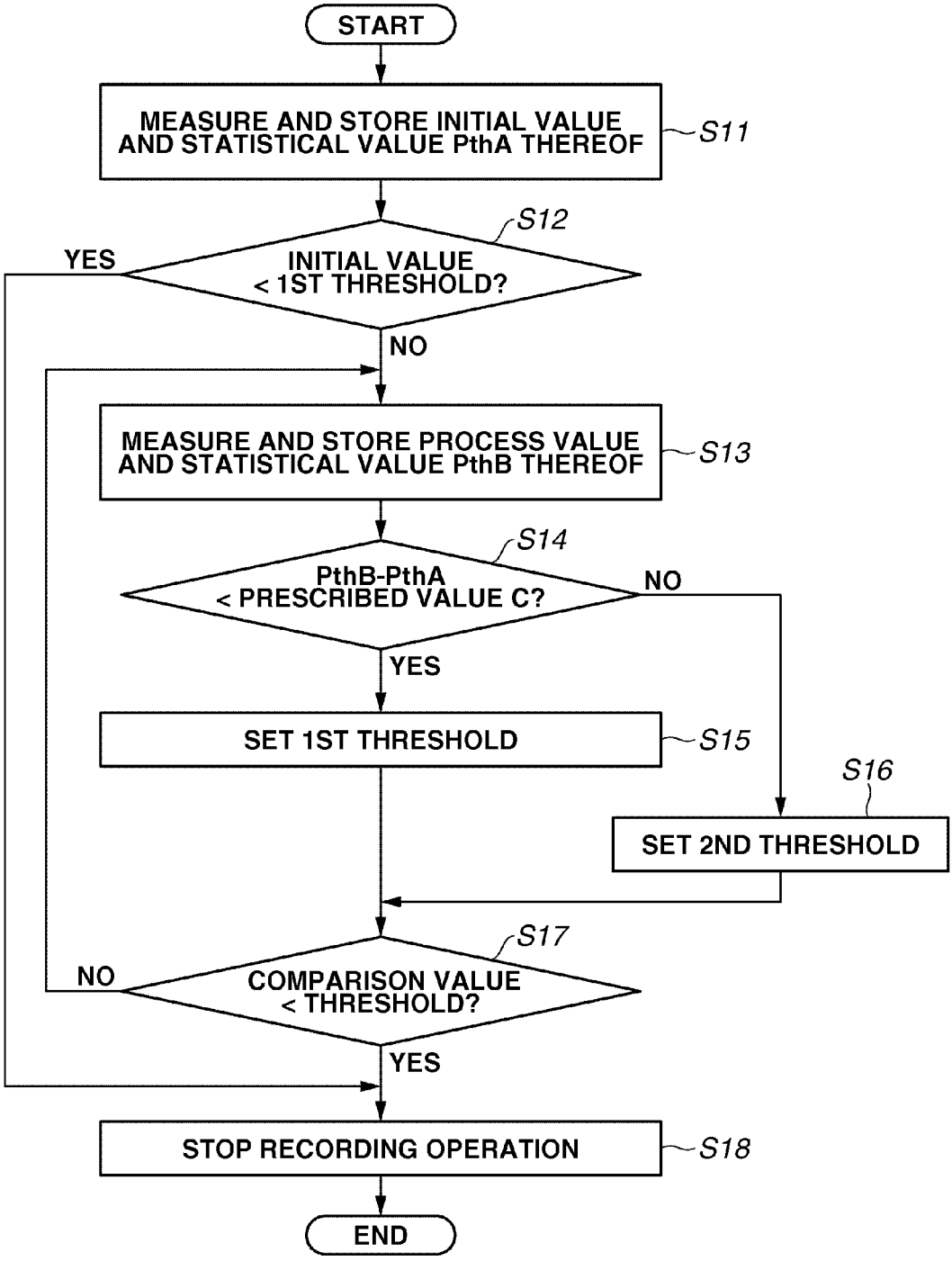
FIG. 9 illustrates a flowchart of a procedure for abnormality detection operation of an inkjet recording head in an inkjet recording apparatus according to a second exemplary embodiment.

FIG. 9 illustrates a flowchart of the abnormality detection operation of the inkjet recording head executed by the inkjet recording apparatus procedure according to the present exemplary embodiment.

In step S11, the control unit 13 measures the initial value and the statistical value PthA and stores the values in the storage unit 14. In step S12, the control unit 13 determines whether or not any of the initial values is less than the first threshold. When any of the initial value is less than the first threshold (YES in step S12), in step S18, the control unit 13 stops the recording operation of the inkjet recording head 109. After the control unit 13 confirms that all initial values are more than the first threshold (NO in step S12), the timer 23 starts to count up time. After the elapse of predetermined time, in step S13, the control unit 13 measures all energy values Pth of the heat generation resistor 7 and the statistical value PthB of the energy value Pth. A measured energy value Pth at this time is referred to as a process value. In step S13, the control unit 13 stores the process value and the statistical value PthB in the storage unit 14.

In step S14, the control unit 13 calculates the difference between the statistical values PthB and PthA, and determines whether or not the difference is smaller than a predetermined prescribed value C. When the difference between the statistical values PthB and PthA is smaller than the prescribed value C (YES in step S14), in step S15, the control unit 13 sets the first threshold. When the difference between the statistical values PthB and PthA is smaller than the prescribed value C (NO in step S14), in step S16, the control unit 13 sets the second threshold. The second threshold is obtained by adding the difference between the statistical values PthB and PthA to the first threshold.

When setting the thresholds, in step S17, the control unit 13 determines whether or not an N-th smallest comparison value counted from the minimum one of the process values measured in step S13 is less than the set threshold, where N is a natural number and an upper limit value is a number of measurement of the process value. When the comparison value is less than the threshold (YES in step S17), in step S18, the control unit 13 determines that the protection film 69 is dissolved by the ink, and stops the recording operation of the inkjet recording head 109. On the other hand, when the comparison value is more than the threshold (NO in step S17), the control unit 13 determines that the protection film 69 is not dissolved, resets the timer 23, and returns to the operation in step S13. The operation in steps S13 to S17 is periodically performed.

In the above operation procedure, the trial term corresponds to ten years, and in the inkjet recording apparatus 100 in which the dissolution of the protection film 69 has advanced, the dissolution of the protection film 69 could be detected before the damage of the inkjet recording head 109 increases.

According to the present exemplary embodiment, similarly to the first exemplary embodiment, when the initial value and the process value are measured and the N-th smallest process value from the minimum one is less than the threshold, the recording operation of the inkjet recording head 109 stops. Therefore, even when the protection film 69 is dissolved by the ink flowing from the supply port 11, the change in energy value at this time is detected. Thus, the recording operation of the inkjet recording head 109 immediately stops. Thus, the influence of the dissolution of the protection film 69, on the main body 101, is prevented, thereby suppressing the damage of the inkjet recording head 109 to be at the minimum level.

According to the present exemplary embodiment, in the comparison of the dissolution of the protection film 69, the process values are not compared with the threshold, but the N-th smallest process value from the minimum one is compared with the threshold. Therefore, even when measuring an excessively small energy value Pth only at one place due to erroneous detection of the sensor 3, N=3 is set, thereby preventing erroneous detection of the dissolution of the protection film 69 by the control unit 13 due to the erroneous detection of the sensor 3.

According to the present exemplary embodiment, in step S17, the threshold is set. Then, only the comparison values in the process values may be stored in the storage unit 14 in the measurement order. Thus, the capacity of the storage unit 14 can be reduced.

An inkjet recording apparatus according to a third exemplary embodiment is described below. An inkjet recording apparatus according to the present exemplary embodiment is similar to the inkjet recording apparatus 100, except for different contents of the abnormality detection operation of the inkjet recording head. Therefore, the contents similar to the first exemplary embodiment are not specifically described.

Figure 10:
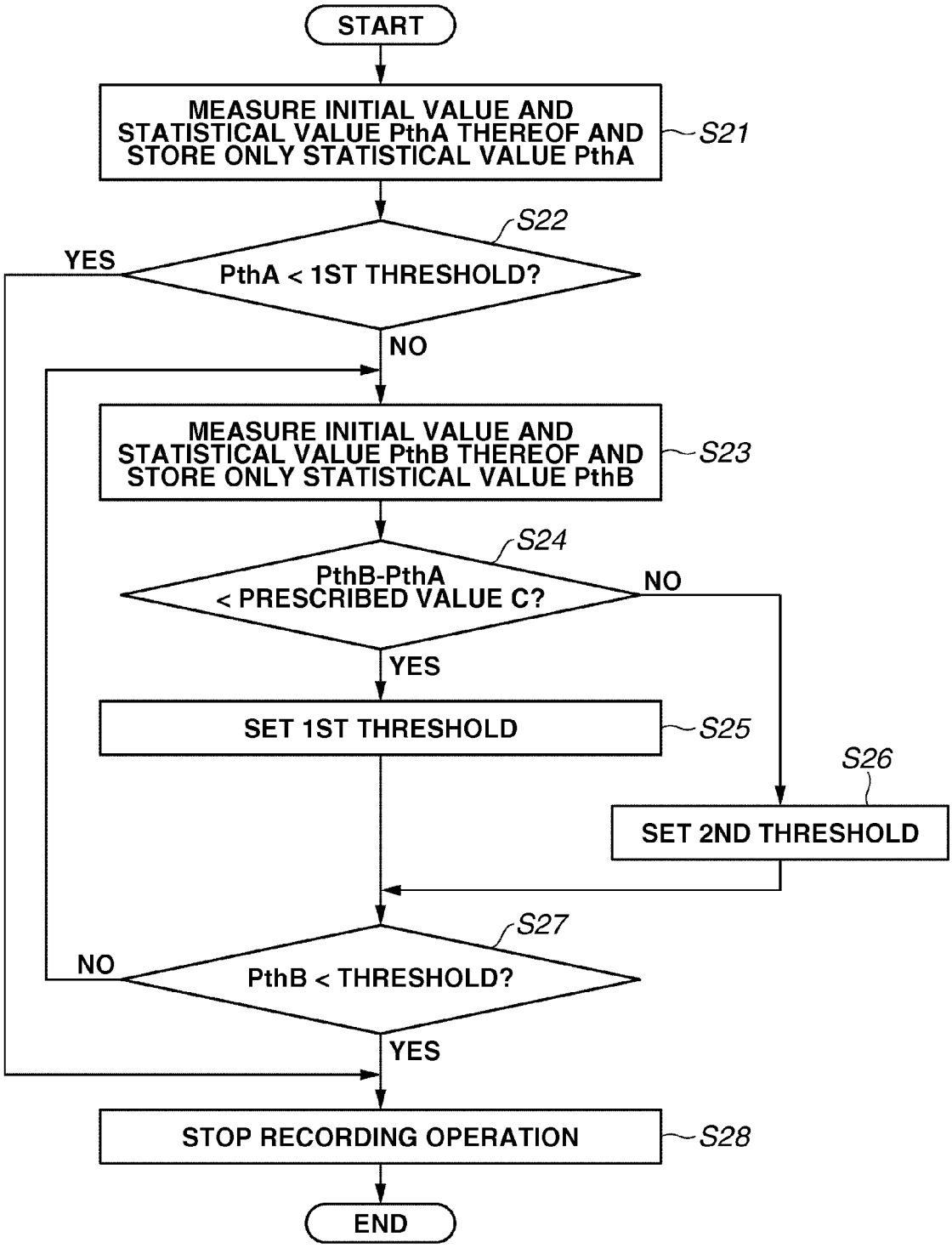
FIG. 10 illustrates a flowchart of a procedure for abnormality detection operation of an inkjet recording head in an inkjet recording apparatus according to a third exemplary embodiment.
Figure 11:
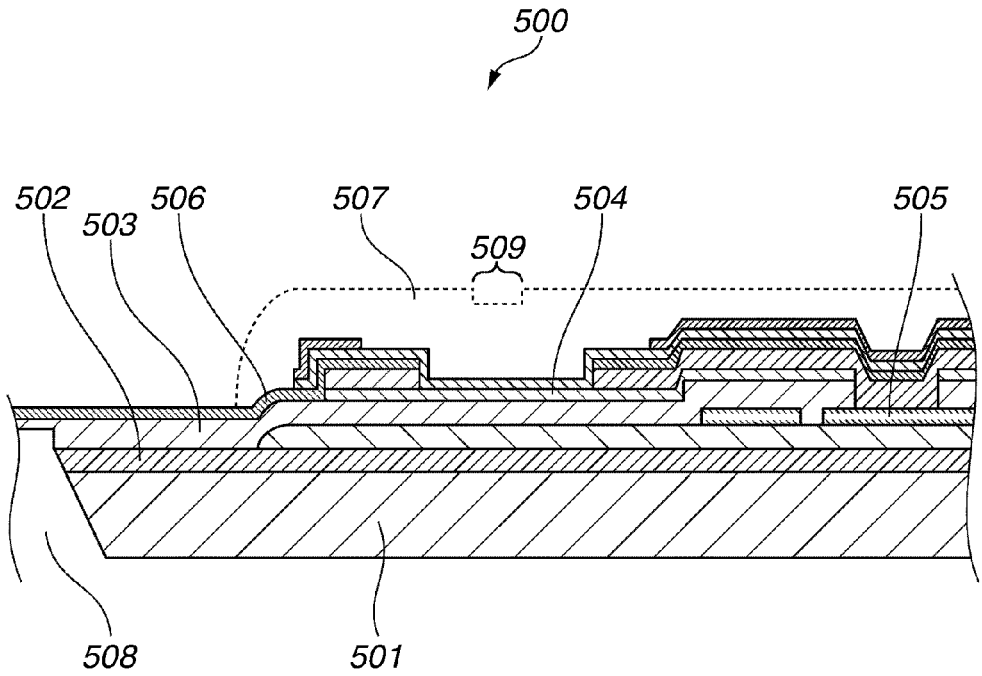
FIG. 11 illustrates a cross-sectional view of a configuration of a conventional inkjet recording head used for a thermal-type inkjet recording apparatus.

FIG. 10 illustrates a flowchart of a procedure of an abnormality detection operation of the inkjet recording head executed by the inkjet recording apparatus according to the present exemplary embodiment.

In step S21, the control unit 13 measures the initial value and the statistical value PthA, and stores only the statistical value PthA in the storage unit 14. In step S22, the control unit 13 determines whether or not the statistical value PthA is less than the first threshold. When the statistical value PthA is less than the first threshold (YES in step S22), in step S28, the control unit 13 stops the recording operation of the inkjet recording head 109. After the control unit 13 confirms that the statistical value PthA is more than the first threshold (NO in step S22), the timer 23 starts to count up time. After the elapse of predetermined time, in step S23, the control unit 13 measures again energy values Pth of all the heat generation resistors 7 and the statistical values PthB of the energy values Pth. The measured energy value Pth at this time is referred to as a process value. In step S23, control unit 13 stores only the statistical value PthB in the storage unit 14.

In step S24, the control unit 13 calculates the difference between the statistical values PthB and PthA, and determines whether or not the difference is smaller than a predetermined prescribed value C. When the difference between the statistical values PthB and PthA is smaller than the prescribed value C (YES in step S24), in step S25, the control unit 13 sets a first threshold. On the other hand, when the difference between the statistical values PthB and PthA is more than the prescribed value C (NO in step S24), in step S26, the control unit 13 sets the threshold to be compared with the process value as a second threshold. The second threshold is obtained by adding the difference between the statistical values PthB and PthA to the first threshold.

After setting the thresholds, in step S27, the control unit 13 determines whether or not the statistical value PthB stored in the storage unit 14 is less than the thresholds. When the statistical value PthB is less the thresholds (YES in step S27), in step S28, the control unit 13 determines that the protection film 69 is dissolved by the ink, and stops the recording operation of the inkjet recording head 109. On the other hand, when the statistical value PthB is more than the thresholds (NO in step S27), the control unit 13 determines that the protection film 69 is not dissolved, resets the timer 23, and returns to the operation in step S23. The operation in steps S23 to S27 is periodically performed.

In the operation procedure, the trial term corresponds to ten years and the inkjet recording apparatus 100 in which the dissolution of the protection film 69 has advanced, the dissolution of the protection film 69 could be detected before the damage of the inkjet recording head 109 increases.

According to the present exemplary embodiment, similarly to the first exemplary embodiment, when the process value and the statistical value are measured and the statistical value of the process value is less than the threshold, the recording operation of the inkjet recording head 109 stops. Therefore, even when the protection film 69 is dissolved by the ink flowing from the supply port 11, the change in energy value at this time is detected. As a consequence, the recording operation of the inkjet recording head 109 immediately stops. Thus, the influence of the dissolution of the protection film 69, on the main body 101, is prevented, thereby suppressing the damage of the inkjet recording head 109 to be at the minimum level.

According to the present exemplary embodiment, the energy values Pth of all the heat generation resistors 7 are measured. However, only the statistical value is stored in the storage unit 14. When determining the dissolution of the protection film 69, the process values is not compared with the threshold, but the statistical value of the process value is compared with the threshold. As a consequence, the capacity of the storage unit 14 can be further reduced and time for determining the dissolution of the protection film 69 can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-010939 filed Jan. 21, 2010, which is hereby incorporated by reference herein in its entirety.

What is claimed is:

1. An inkjet recording apparatus for recording an image on a print medium, the inkjet recording apparatus comprising:

a liquid discharge head including a heat generation resistor configured to generate thermal energy used for discharging liquid to the print medium and a protection film disposed in at least one of an upper portion and a lower portion of the heat generation resistor;

an obtaining unit configured to obtain information relating to an energy value required for discharging a liquid by the heat generation resistor; and a control unit configured to inhibit a recording operation to a print medium by the liquid discharge head based on the information obtained by the obtaining unit when the energy value indicated by the information is less than a predetermined threshold energy value.

2. The inkjet recording apparatus according to claim 1, further comprising:

a sensor including a light emission portion adjacent to a flying path of liquid discharged from the liquid discharge head, and a light reception portion facing the light emission portion across the flying path and configured to output a light reception status of light output from the light emission portion to the control unit, wherein the obtaining unit changes at least one of a value of a voltage applied to the heat generation resistor and voltage application time and detects change of the light reception status of the light reception portion, thereby obtaining the information by measuring the energy value.

3. The inkjet recording apparatus according to claim 1, wherein when the control unit confirms that an initial value as a first measured energy value measured by the obtaining unit is more than the predetermined threshold energy value, the obtaining unit thereafter measuring a process value of an energy value after measuring the initial value, and the control unit inhibits the recording operation of the inkjet recording head when any process value obtained by the obtaining unit is less than the predetermined threshold energy value.

4. The inkjet recording apparatus according to claim 3, wherein the control unit calculates a difference between a statistical value of the process value and a statistical value of the initial value after measuring the process value by the obtaining unit, sets a first threshold set at a time of measuring the initial value as a threshold to be compared with the process value when the difference is less than a prescribed value, and sets a second threshold obtained by adding the difference to the first threshold as a threshold to be compared with the process value when the difference is more than the prescribed value.

5. The inkjet recording apparatus according to claim 4, wherein the statistical value is an average value.

6. The inkjet recording apparatus according to claim 1, wherein when the control unit confirms that an initial value of a first measured energy value is more than the predetermined threshold energy value, the obtaining unit then obtains a plurality of process values of energy values after measuring the initial value, and the control unit inhibits the recording operation of the inkjet recording head when an N-th smallest process value counted from a minimum process value of the plurality of the process values is less than the predetermined threshold energy value, wherein N is a natural number.

7. The inkjet recording apparatus according to claim 6, further comprising:

a storage unit configured to store the initial value, wherein the control unit stores the N-th smallest process value counted from the minimum value in the storage unit after setting the predetermined threshold energy value.

8. The inkjet recording apparatus according to claim 1, wherein when the control unit confirms that a statistical value of an initial value as a first measured energy value is more than the predetermined threshold energy value, the obtaining unit then measures a process value as the energy value after measuring the initial value and a statistical value of the process value, and the control unit inhibits the recording operation of the inkjet recording head when the statistical value of the process value obtained by the obtaining unit is less than the predetermined threshold energy value.

9. The inkjet recording apparatus according to claim 8, further comprising:

a storage unit configured to store the initial value, wherein the control unit measures the process value and the statistical value of the process value, and thereafter stores the statistical value of the process value in the storage unit.

10. The inkjet recording apparatus according to claim 1, further comprising an informing unit configured to give user information about the liquid discharge head in a case where the energy value indicated by the obtained information is less than a predetermined threshold energy value.

11. The inkjet recording apparatus according to claim 10, wherein the user information indicates abnormality of the liquid discharge head.

12. The inkjet recording apparatus according to claim 10, wherein the user information prompts exchange of the liquid discharge head.

13. The inkjet recording apparatus according to claim 10, wherein the informing unit causes a display unit to display the user information about the liquid discharge head.

14. A method of controlling an inkjet recording apparatus for recording an image on a print medium, the method comprising:

providing a liquid discharge head including a heat generation resistor configured to generate thermal energy used for discharging liquid to the print medium and a protection film disposed in at least one of an upper portion and a lower portion of the heat generation resistor;

obtaining information relating to an energy value required for discharging a liquid by the heat generation resistor; and inhibiting a recording operation to a print medium by the liquid discharge head based on the obtained information when the energy value indicated by the information is less than a predetermined threshold energy value.

* * * * *